US010633904B2

(12) United States Patent
Elkasevic

(10) Patent No.: US 10,633,904 B2
(45) Date of Patent: Apr. 28, 2020

(54) DOMESTIC APPLIANCE HINGE ASSEMBLY WITH CYLINDER ALIGNMENT SHOULDER BUSHING

(75) Inventor: Suad Elkasevic, Winterville, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 779 days.

(21) Appl. No.: 13/478,277

(22) Filed: May 23, 2012

(65) Prior Publication Data

US 2013/0312221 A1 Nov. 28, 2013

(51) Int. Cl.

| | |
|---|---|
| ***E05F 3/10*** | (2006.01) |
| ***E05F 1/12*** | (2006.01) |
| ***F24C 15/02*** | (2006.01) |

(52) U.S. Cl.

CPC ..... *E05F 3/108* (2013.01); *E05F 1/1261* (2013.01); *F24C 15/023* (2013.01); *E05Y 2201/21* (2013.01); *E05Y 2201/254* (2013.01); *E05Y 2201/264* (2013.01); *E05Y 2201/624* (2013.01); *E05Y 2201/626* (2013.01); *E05Y 2900/308* (2013.01); *Y10T 16/54025* (2015.01)

(58) Field of Classification Search

CPC . E05F 1/1261; E05Y 2900/308; F24C 15/023
USPC ..... 16/286, 287, 288, 289, 290, 291
See application file for complete search history.

(56) References Cited

U.S. PATENT DOCUMENTS

| | | | | |
|---|---|---|---|---|
| 3,450,125 | A * | 6/1969 | Hopkins | 126/191 |
| 3,712,287 | A * | 1/1973 | Summers, Jr. | 126/191 |
| 3,749,080 | A * | 7/1973 | Kleinhenn | 126/191 |
| 5,025,776 | A * | 6/1991 | Hanley et al. | 126/194 |
| 6,719,383 | B2 | 4/2004 | Elick et al. | |
| 6,789,293 | B2 | 9/2004 | Habegger et al. | |
| 6,892,424 | B1 * | 5/2005 | Habegger et al. | 16/289 |
| 6,986,187 | B2 * | 1/2006 | Cummins et al. | 16/286 |
| 7,017,232 | B1 * | 3/2006 | Priddy | E05F 1/1276 16/286 |
| 7,676,888 | B2 | 3/2010 | Vanini | |
| 2003/0213098 | A1 * | 11/2003 | Cummins et al. | 16/286 |
| 2006/0230578 | A1 * | 10/2006 | Renke et al. | 16/289 |
| 2007/0101542 | A1 * | 5/2007 | Lee | 16/286 |
| 2008/0168618 | A1 | 7/2008 | Hottmann | |
| 2008/0295283 | A1 | 12/2008 | Tice | |
| 2010/0018240 | A1 | 1/2010 | Hecht et al. | |
| 2010/0051067 | A1 | 3/2010 | Dalsing | |
| 2010/0109497 | A1 | 5/2010 | Blersch et al. | |
| 2010/0127606 | A1 | 5/2010 | Collene | |

(Continued)

*Primary Examiner* — Jeffrey O'Brien
(74) *Attorney, Agent, or Firm* — Michael E. Tschupp; Andre Pallapies; Brandon G. Braun

(57) ABSTRACT

A hinge assembly is provided for attaching a door to a domestic appliance. The hinge assembly includes a hinge body; a damper; a foot pivotably attached to the damper and having a pivot end, the foot engaging a foot receiving portion of the appliance such that the hinge body and the door pivot relative to the appliance; and a shoulder bushing attached to the pivot end of the foot and to a pivot point of the hinge body such that the foot pivots relative to the hinge body around the pivot point, the shoulder bushing having a large diameter portion and a small diameter portion. The pivot end of the foot is fixed to the shoulder bushing at a fixing area of the small diameter portion such that a side surface of the pivot end of the foot is in contact with a side surface of the large diameter portion.

20 Claims, 3 Drawing Sheets

(56) References Cited

U.S. PATENT DOCUMENTS

| | | | |
|---|---|---|---|
| 2010/0139169 | A1 | 6/2010 | Patil et al. |
| 2010/0148646 | A1 | 6/2010 | Bettinzoli |
| 2010/0281650 | A1 | 11/2010 | Kleemann et al. |
| 2011/0017191 | A1 | 1/2011 | White et al. |
| 2011/0068671 | A1 | 3/2011 | Vanini |

* cited by examiner

DOMESTIC APPLIANCE HINGE ASSEMBLY WITH CYLINDER ALIGNMENT SHOULDER BUSHING

FIELD OF THE INVENTION

The invention is directed to a hinge assembly for a domestic appliance. The hinge assembly has a shoulder bushing to ensure proper alignment of a foot and damper in the hinge body.

An example of an application for the invention is a hinge assembly used with a door of a domestic appliance.

BACKGROUND OF THE INVENTION

Many domestic appliances, such as built in ovens, have one or more doors that swing open about a horizontal axis such that the door swings downward into an open position. Such a door is often heavy and uses springs of significant strength to counteract a portion of the weight of the door so that it is easier for a user to open and close the door. These springs often act to slam the door into the closed position after the door has passed a particular rotational position when moved upward toward the closed position. This slamming is undesirable for at least the reasons that it can make a loud noise, it can damage the appliance over time, and it gives the appearance of low quality. The result of such slamming is usually that the user continues to hold the door until it has reached the closed position.

To prevent the undesirable slamming, soft-close hinges can be employed. Soft-close hinges often include some type of damper that slows the movement of the door for a predetermined distance before the door reaches the closed position. This damping prevents the slamming of the door and results in a much more desirable appliance.

SUMMARY

Some dampers include a spring mounted inside a cylinder. The spring is often very long compared to its diameter in order to fit inside the cylinder. The damper can include a rod that moves relative to the cylinder when the damper is operated. A hinge assembly can include a damper, a spring, a hinge body, and a hinge foot. Often a domestic appliance, an oven for example, is provided with one hinge assembly on each side of an opening which is covered by the door. The hinge foot can be provided with an engagement portion that engages a foot receiving portion on the body of the domestic appliance. Due to the spring and damper forces acting on the foot and the foot receiving portion, and the weight of the door, a strong and secure locating system for the pivot point of the foot is required.

The invention recognizes the existence of the above described forces acting on the foot and recognizes the need for a strong and secure locating system for the pivot point of the foot. The invention recognizes that even minor movements of the pivot point of the foot can cause increased loads on the pivot structure, can cause undesirable noise, can change the closing time of the door, and can make it more difficult to remove the door.

Particular embodiments of the invention are directed to a hinge assembly for pivotably attaching a door to a domestic appliance having an appliance body. The hinge assembly includes a hinge body; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper and having a pivot end, the foot being configured to engage a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion. The pivot end of the foot is fixed to the shoulder bushing at a fixing area of the small diameter portion such that a side surface of the pivot end of the foot is in contact with a side surface of the large diameter portion.

Other embodiments of the invention are directed to a door assembly for pivotably attaching to a domestic appliance having an appliance body. The door assembly has a door; and a hinge assembly. The hinge assembly includes a hinge body; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper and having a pivot end, the foot being configured to engage a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion. The pivot end of the foot is fixed to the shoulder bushing at a fixing area of the small diameter portion such that a side surface of the pivot end of the foot is in contact with a side surface of the large diameter portion.

Other embodiments of the invention are directed to a domestic appliance having an appliance body having a foot receiving portion; a door; and a hinge assembly. The hinge assembly includes a hinge body; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper and having a pivot end, the foot engaging a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion. The pivot end of the foot is fixed to the shoulder bushing at a fixing area of the small diameter portion such that a side surface of the pivot end of the foot is in contact with a side surface of the large diameter portion.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Many domestic appliances, such as, for example, built-in ovens, have a door that pivots relative to the body of the appliance to permit access to an internal space of the appliance. These doors are often heavy due to glass view panels, insulation, ventilating structure, and other elements. Springs are often used to reduce the effort needed from the user to close the door. These springs can be strong in order to exert a force that counteracts a large portion of the weight of a heavy door. The result of strong springs is often a slamming of the door once the door passes a particular point in the pivoting.

One or more dampers can be used to damp the closing action resulting from the strong springs to eliminate the slamming that can be caused by undamped springs. The dampers can be any type of damper including, but not limited to, gas filled or liquid filled dampers. Examples of fluid (gas and/or liquid) filled dampers have a cylinder that contains the fluid and may or may not include one or more orifices through which the fluid moves to create the damping force.

Some door hinge assemblies include both a spring and a damper. Some of these door hinge assemblies place the spring inside the damper cylinder to provide a compact assembly.

Figure 1:
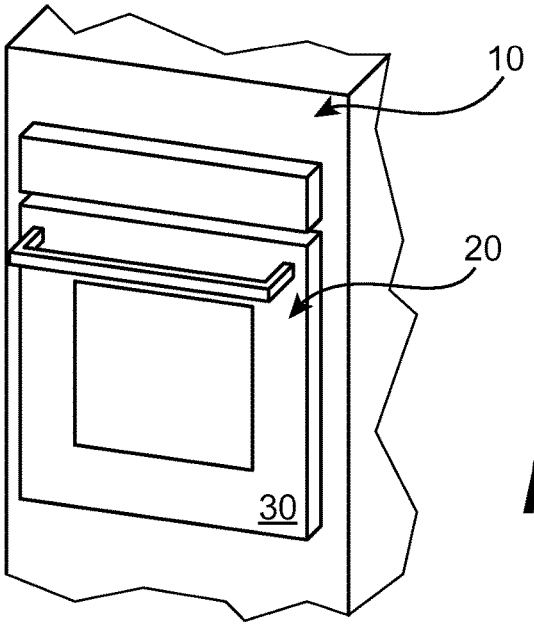
FIG. 1 is a perspective view of a domestic appliance in accordance with exemplary embodiments of the invention.

FIG. 1 shows an example of a domestic appliance 20 mounted in a cabinet 10. An example of a domestic appliance 20 is a cabinet-mounted oven. In this example, domestic appliance 20 includes a door 30 pivotably attached to a body of domestic appliance 20 to selectively open and close an interior space of domestic appliance 20. In some embodiments, door 30 is attached to the body of domestic appliance 20 by two hinge assemblies. Examples of the hinge assemblies are discussed below.

Figure 2:
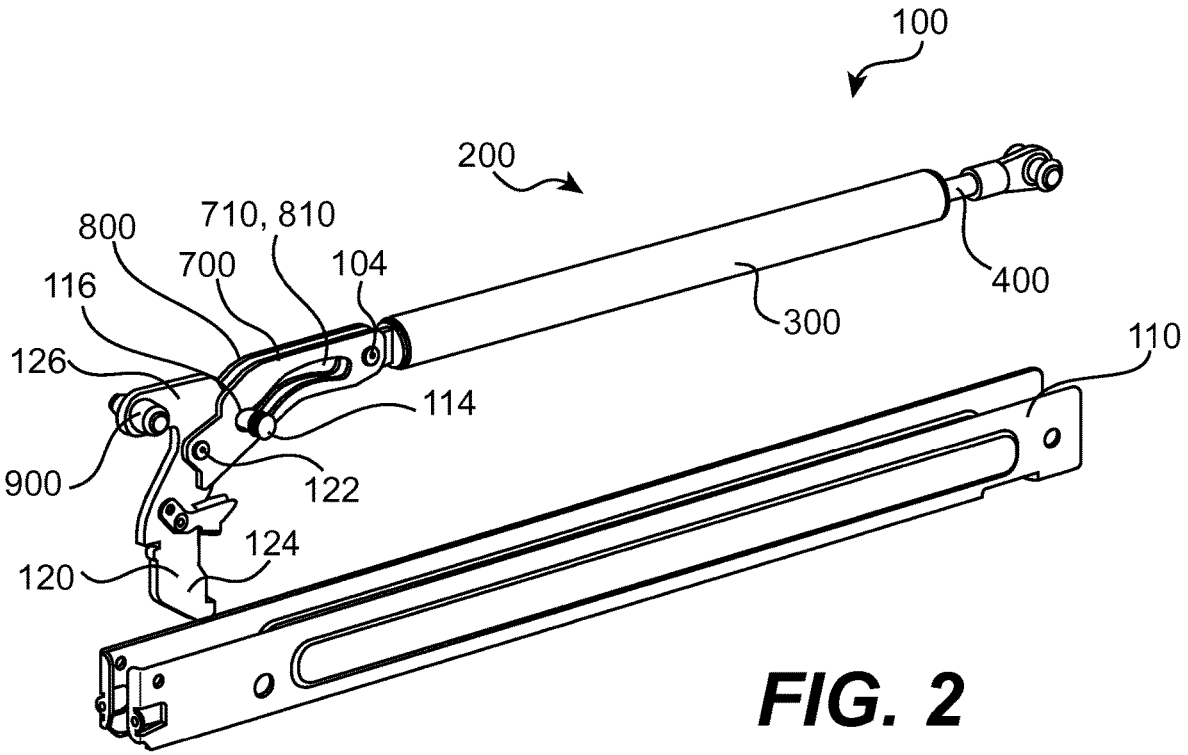
FIG. 2 is a partial exploded perspective view of a hinge assembly in accordance with exemplary embodiments of the invention.

FIG. 2 shows a hinge assembly 100 that can be used to pivotably attach door 30 to the body of domestic appliance 20. In particular embodiments, two hinge assemblies 100 are used, one on each side of the opening of the interior space of domestic appliance 20. A hinge assembly body 110 partially surrounds an assembly that includes a damper 200, a linkage 700, 800, and a foot 120.

Damper 200 includes a cylinder 300 and a rod 400. Rod 400 is partially inside cylinder 300 and partially outside cylinder 300 and moves in a reciprocating motion relative to cylinder 300. A damping force is applied to rod 400 as it moves relative to cylinder 300 and damps the motion of rod 400 relative to cylinder 300. This damping force can result from a fluid inside cylinder 300 being forced through at least one aperture when rod 400 moves, or from some other type of damping mechanism.

Figure 3:
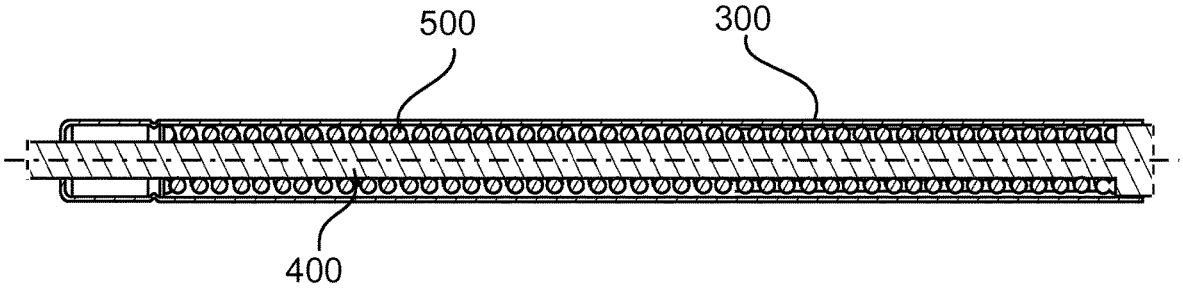
FIG. 3 is a sectional view of a damper in accordance with exemplary embodiments of the invention.

Embodiments of the invention include a coil spring positioned inside cylinder 300 as shown in FIG. 3. FIG. 3 shows rod 400 extending through the center of spring 500 and including a shoulder that supports the right side end of spring 500. As rod 400 is moved to the left in the figure, spring 500 is compressed. This movement corresponds to door 30 being moved from the closed position to the open position. As rod 400 is moved farther to the left, spring 500 becomes increasingly more compressed.

In particular embodiments, hinge assembly 100 is attached to door 30 such that hinge body 110 does not move relative to door 30. As shown in FIG. 2, foot 120 is pivotably attached to damper 200 by a pin 122. An engagement end 124 of foot 120 engages a foot receiving feature (for example foot receiving portion 600 shown in FIG. 4) on domestic appliance 20 to attach door 30 to domestic appliance 20. Hinge assembly 100 and door 30 are then pivotable relative to the body of domestic appliance 20. Foot 120 is attached in this embodiment to the end of cylinder 300 by a first linkage member 700 and a second linkage member 800 such that foot 120 can pivot relative to cylinder 300. First and second linkage members 700, 800 are pivotably attached to cylinder 300 by a pin 104 and are pivotably attached to foot 120 by pin 122.

First linkage member 700 and second linkage member 800 have slots 710, 810, respectively, formed in them to receive a pin 114. FIG. 2 shows pin 114 removed from hinge body 110 to illustrate how slots 710, 810 engage pin 114. In this example, pin 114 includes a roller 116 that rotates around a center portion of pin 114 that is attached to hinge body 110 in order to provide a smooth rolling relationship between slots 710, 810 and pin 114.

The damping forces in conjunction with the curved shape of slots 710, 810 subject the hinge assembly to different forces at different points of travel of pin 114 through slots 710, 810. Applicant recognized the existence of the above described forces acting on the foot and recognized the need for a strong and secure locating system for the pivot point of the foot. Applicant recognized that even minor movements of the pivot point of the foot can cause increased loads on the pivot structure, can cause undesirable noise, can change the closing time of the door, and can make it more difficult to remove the door. This strong and secure locating system for the pivot point of the foot is more important in order to ensure the smooth operation of a damped hinge assembly than a non-damped hinge because of these differing forces.

Figure 4:
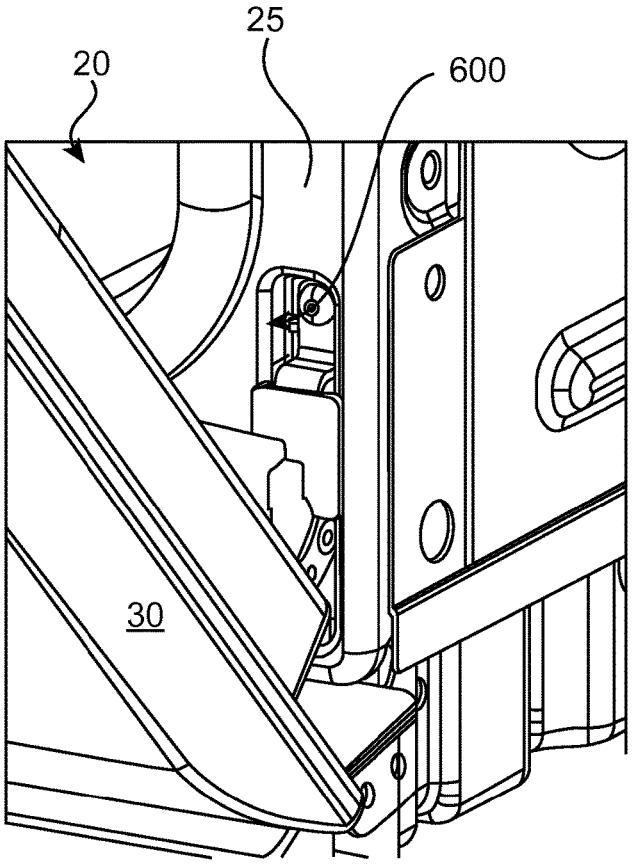
FIG. 4 is a perspective view of a domestic appliance in accordance with embodiments of the invention.

FIG. 4 shows door 30 attached to body 25 of domestic appliance 20, and in a partially opened position. Engagement end 124 of foot 120 is engaged with foot receiving portion 600 to keep door 30 attached to body 25.

Figure 5:
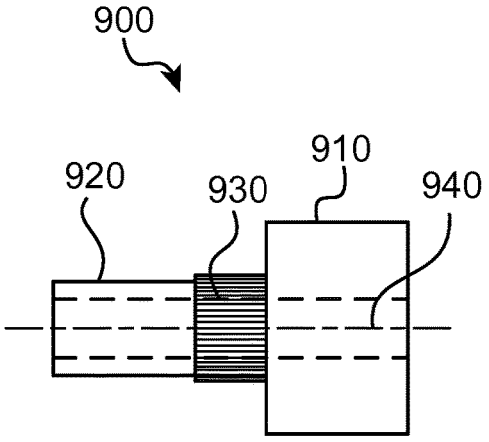
FIG. 5 is a side view of an element of an exemplary embodiment of the invention.
Figure 6:
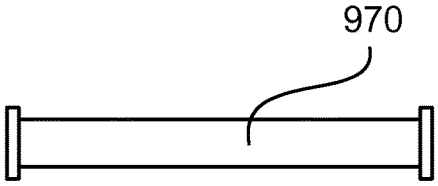
FIG. 6 is a side view of an element of an exemplary embodiment of the invention.

FIGS. 5 and 6 show a shoulder bushing 900 in accordance with embodiments of the invention. Shoulder bushing 900 is an example of a locating system for the pivot point of the foot. The example shown in FIGS. 5 and 6 has an outer portion and an inner portion. The outer portion (FIG. 5) has a large diameter portion 910 and a small diameter portion 920. In this example, small diameter portion 920 has a splined section 930 that receives a hole in pivot end 126 of foot 120. Foot 120 is pushed over the end of small diameter portion 920 and onto splined section 930 such that foot 120 is fixed relative to shoulder bushing 900. Although this example shows a splined section 930, other high-friction connections between shoulder bushing 900 and foot 120 can be used. FIG. 5 shows a through hole 940 in shoulder bushing 900.

Figure 7:
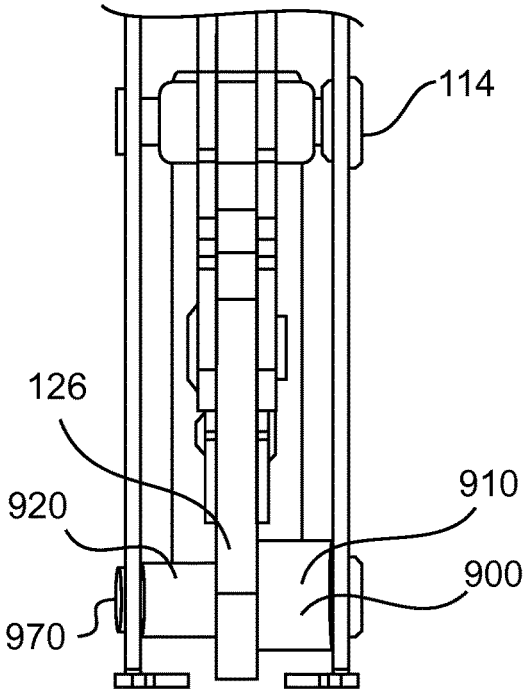
FIG. 7 is a top view of an exemplary embodiment of the invention.
Figure 8:
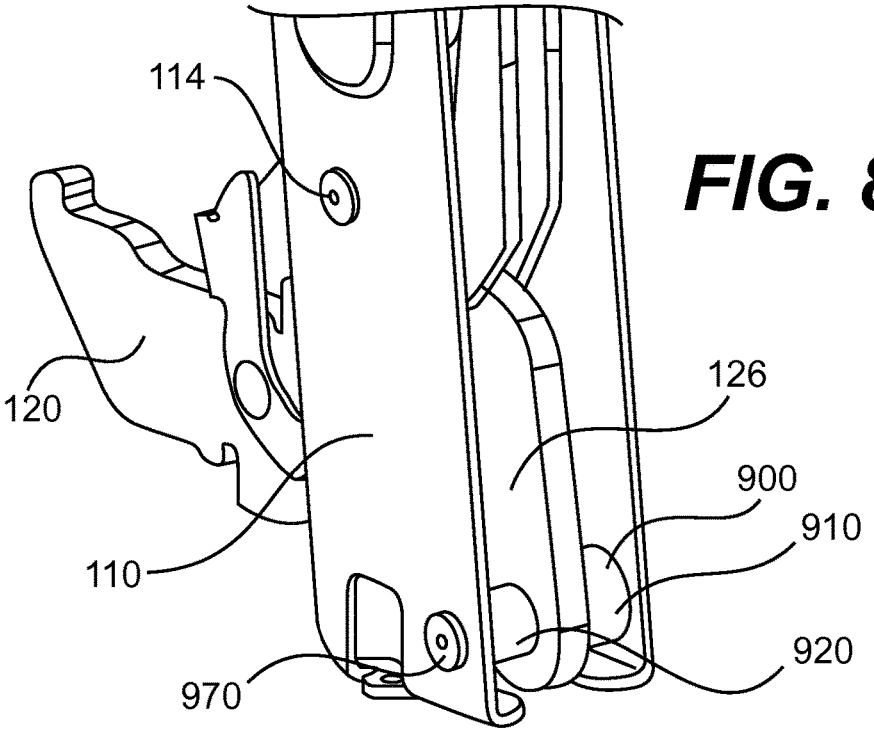
FIG. 8 is a perspective view of an exemplary embodiment of the invention.

FIG. 6 shows an example of an inner portion 970 of shoulder bushing 900. An example of inner portion 970 is a rivet that rivets the outer portion of shoulder bushing 900 in place between side rails of hinge body 110 (as shown in FIGS. 7 and 8). In particular embodiments, the outer portion of shoulder bushing 900 rotates around inner portion 970.

Applicant notes that in domestic appliances that have two hinge assemblies, particularly when the hinge assemblies are located or different sides of a door opening, slightly different spring characteristics, slightly different damper characteristics, and/or uneven wear of the spring, damper, or other components, can cause the hinge assemblies to operate with different force and damping characteristics. Such differences can result in unequal forces acting on the door of the domestic appliance. These unequal forces can act to twist or skew the door relative to the appliance body. The locating system for the pivot point of the foot in accordance with the invention resists these forces as well as the damper/spring forces discussed above.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge assembly for pivotably attaching a door to a domestic appliance having an appliance body, the hinge assembly comprising:

a hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper;

a pair of linkage members coupled to the damper and forming a slot therein to receive a linkage member pin;

a foot pivotably attached to the pair of linkage members and having a pivot end, the foot operable to engage a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion, wherein the pivot end of the foot is fixed to the shoulder bushing at a fixing area of the small diameter portion such that a side surface of the pivot end of the foot is in contact with a side surface of the large diameter portion.

2. The hinge assembly of claim 1, wherein the linkage member pin includes a roller that rotates around a center portion of the linkage member pin, which is attached to the hinge body.

3. The hinge assembly of claim 2, wherein the slot is curved.

4. The hinge assembly of claim 1, wherein the slot is curved.

5. The hinge assembly of claim 1, wherein the shoulder bushing has an outer portion that includes the large diameter portion and the small diameter portion, the outer portion having a through hole, and an inner portion that extend through the through hole and around which the outer portion rotates.

6. The hinge assembly of claim 5, wherein the inner portion of the shoulder bushing is a rivet.

7. A door assembly for pivotably attaching to a domestic appliance having an appliance body, the door assembly comprising:

a door;

a hinge assembly, the hinge assembly having a hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper;

a pair of linkage members coupled to the damper and forming a slot therein to receive a linkage member pin;

a foot pivotably attached to the pair of linkage members and having a pivot end, the foot operable to engage a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion, wherein the pivot end of the foot is fixed to the shoulder bushing at a fixing area of the small diameter portion such that a side surface of the pivot end of the foot is in contact with a side surface of the large diameter portion.

8. The door assembly of claim 7, wherein the linkage member pin includes a roller that rotates around a center portion of the linkage member pin, which is attached to the hinge body.

9. The door assembly of claim 8, wherein the slot is curved.

10. The door assembly of claim 7, wherein the slot is curved.

11. The door assembly of claim 7, wherein the shoulder bushing has an outer portion that includes the large diameter portion and the small diameter portion, the outer portion having a through hole, and an inner portion that extend through the through hole and around which the outer portion rotates.

12. The door assembly of claim 11, wherein the inner portion of the shoulder bushing is a rivet.

13. A domestic appliance, comprising:

an appliance body having a foot receiving portion;

a door; and a hinge assembly, the hinge assembly having a hinge body;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper;

a pair of linkage members coupled to the damper and forming a slot therein to receive a linkage member pin;

a foot pivotably attached to the pair of linkage members and having a pivot end, the foot operable to engage a foot receiving portion of the appliance body such that the hinge body and the door pivot relative to the appliance body; and a shoulder bushing attached to the pivot end of the foot and to a pivot point of the hinge body such that the foot pivots relative to the hinge body around the pivot point, the shoulder bushing having a large diameter portion and a small diameter portion, wherein the pivot end of the foot is fixed to the shoulder bushing at a fixing area of the small diameter portion such that a side surface of the pivot end of the foot is in contact with a side surface of the large diameter portion.

14. The domestic appliance of claim 13, wherein the linkage member pin includes a roller that rotates around a center portion of the linkage member pin, which is attached to the hinge body.

15. The domestic appliance of claim 14, wherein the slot is curved.

16. The domestic appliance of claim 13, wherein the slot is curved.

17. The domestic appliance of claim 13, wherein the shoulder bushing has an outer portion that includes the large diameter portion and the small diameter portion, the outer portion having a through hole, and an inner portion that extend through the through hole and around which the outer portion rotates.

18. The domestic appliance of claim 17, wherein the inner portion of the shoulder bushing is a rivet.

19. The hinge assembly of claim 1, wherein the slot has a substantially uniform width.

20. The hinge assembly of claim 19, wherein the linkage member pin has a smooth rolling relationship with the slot.

* * * * *